United States Patent [19]

Wolner

[11] Patent Number: 4,877,110

[45] Date of Patent: Oct. 31, 1989

[54] SAFETY DEVICE WITH RETRACTABLE LIFELINE

[75] Inventor: J. Thomas Wolner, Red Wing, Minn.

[73] Assignee: D B Industries, Inc., Red Wing, Minn.

[21] Appl. No.: 257,599

[22] Filed: Oct. 14, 1988

[51] Int. Cl.[4] ..... A62B 1/10

[52] U.S. Cl. ..... 182/232; 182/18; 182/237; 188/180; 188/65.2

[58] Field of Search ..... 182/232, 231, 236, 237, 182/5, 18; 188/180, 65.1, 65.2

[56] References Cited

U.S. PATENT DOCUMENTS

| | | | |
|---|---|---|---|
| 238,552 | 3/1881 | Barlow . | |
| 489,483 | 1/1893 | Kaye | 182/237 |
| 835,985 | 11/1906 | Sharp | 182/237 |
| 2,561,832 | 7/1951 | Wilson . | |
| 2,680,593 | 6/1954 | McIntyre . | |
| 2,721,685 | 10/1955 | Frankel | 182/236 |
| 2,802,637 | 8/1957 | Gschwind | 182/237 |
| 3,630,488 | 12/1971 | Stangl . | |
| 4,130,176 | 12/1978 | Paulie . | |
| 4,171,795 | 10/1979 | Bianchi | 182/236 |
| 4,301,892 | 11/1981 | Arce . | |
| 4,457,400 | 7/1984 | Donaldson et al. . | |
| 4,480,716 | 11/1984 | Soubry et al. . | |
| 4,511,123 | 4/1985 | Ostrobrod . | |
| 4,523,664 | 6/1985 | Soubry et al. . | |
| 4,589,523 | 5/1986 | Olson et al. . | |
| 4,602,699 | 7/1986 | Matt . | |
| 4,729,454 | 3/1988 | Barelli et al. . | |

OTHER PUBLICATIONS

BH/SALA Safety Device With Retractable Lifeline Parts List.

*Primary Examiner*—Reinaldo P. Machado
*Attorney, Agent, or Firm*—Moore & Hansen

[57] ABSTRACT

A safety device for restraining a person who works at great heights. The device comprises a housing, a drum rotatably mounted and contained within the housing, and a lifeline having a first end attached to the drum, and a second end extending outside the housing and adapted to be connected to a restraint. The lifeline is wound around the drum in response to the drum being rotated in a restraining direction, and the lifeline is unwound from around the drum in response to the drum being rotated in an opposite extending direction. The device also includes a spring for biasing the drum to rotate in the retracting direction, and a brake for braking extending rotation of the drum at an angular velocity in excess of some predetermined speed. When the person wears a body harness having crossed safety straps on one of the person's chest or back, the device further includes an attaching plate for slidably connecting the crossed straps to the housing.

12 Claims, 3 Drawing Sheets

SAFETY DEVICE WITH RETRACTABLE LIFELINE

BACKGROUND OF THE INVENTION

This invention relates to safety devices and, more particularly, to fall arresting devices including retractable lifelines.

SUMMARY OF THE INVENTION

Disclosed is a safety device for restraining a person who works at great heights. The device comprises a housing, a drum rotatably mounted and contained within the housing, and a lifeline having a first end attached to the drum, and a second end extending outside the housing and adapted to be connected to a restraint. The lifeline is wound around the drum in response to the drum being rotated in a retracting direction, and the lifeline is unwound from around the drum in response to the drum being rotated in an opposite extending direction. The device also includes means biasing the drum to rotate in the retracting direction, and means for braking extending rotation of the drum at an angular velocity in excess of some predetermned speed.

In one embodiment, the person wears a body harness having crossed safety straps on one of the person's chest or back, and the device further includes attaching means for slidably connecting the crossed straps to the housing, the attaching means comprising a plate connected to and spaced from the housing so that the crossed straps can be placed between the plate and the housing te straps can slip between the plate and the housing if the person should fall.

In one embodiment, the drum includes a first drum flange, a spaced generally parallel second drum flange, and a cylinder centrally connected between the first drum flange and the second drum flange. A shear pin is parallel to and spaced from the drum cylinder with some predetermined minimum amount of lifeline wound under the shear pin so that the shear pin must be sheared by excessive force before the predetermined amount of lifeline is extended from the housing.

In one embodiment, the drum second flange has a braking surface generally perpendicular to the axis of drum rotation, and the braking means includes a disk assembly in braking pressure contact with the drum brake surface, and means for fixing the disk assembly to the housing in response to the predetermined speed.

In one embodiment, the braking means includes means for fixing the drum to the housing in response to the predetermined speed, and for releasing the drum from the housing only in response to drum retracting rotation of more than ten degrees. The fixing means comprises a pawl mounted on the disk assembly and pivotable into engagement with the housing in response to the predetermined speed, means biasing the pawl out of engagement with the housing when the drum extending rotational velocity is less than the predetermined speed, and means for preventing the pawl disengaging the housing until after more than ten degrees retracting rotation of the drum.

One of the principal features of the invention is the provision of a mechanism for fixing the drum in a safety device including a retractable lifeline so that, in the event a person working at great heights should fall and periodically bump something like a ladder as he falls, or if the restraint to which the lifeline is fixed should flex, the retractable lifeline will not be released by the safety device in an intermittent or ratchet type of fashion. The disclosed device prevents a release of the lifeline until such time as the drum is allowed to rotate in a retracting direction for at least two degrees. This prevents a ratcheting action of the safety device if someone should fall and intermittently hit different objects causing an intermittent change in velocity of the drum.

Another of the principal features of the invention is the provision of a safety device including a retractable lifeline, which device may be attached to the safety straps of a body harness. Prior safety device with retractable lifeline were connected to a restraint, and not connected to a person's body harness. By attaching the safety device to the body harness, there is less danger of the lifeline becoming caught up in some structure, thereby preventing the braking and other features of the safety device from operating properly. Further, by having the device on the person, the person can more readily manipulate the lifeline relative to the device.

Another of the principal features of the invention is the incorporation in the safety device of an improved braking structure. The brake structure incorporated in the device has brake pressure applied between a metal disk and one of the drum flanges. This construction limits the need for the housing to be able to withstand appropriate braking pressures, thereby reducing the overall size of the safety device.

Another of the principal features of the invention is the incorporation in the device of a shear pin which prevents complete extension of the lifeline prior to a person falling, thereby always insuring that the energy absorbing braking feature of the device will operate in the event the person wearing the device should fall.

Other features and advantages of embodiments of the invention will become apparent by reference to the following description, claims and drawings.

DESCRIPTION OF THE PREFERRED EMBODIMENT

Illustrated in FIGS. 1 through 5 is a safety device 10 for restraining a person 14 who works at great heights. Workmen frequently work on platforms, roofs and other structures where it is necessary to provide a safety device for preventing the person from serious injury in the event of an accidental fall. The illustrated device 10 prevents the person from falling a great distance, and reduces the likelihood of injury to the person.

Figure 3:
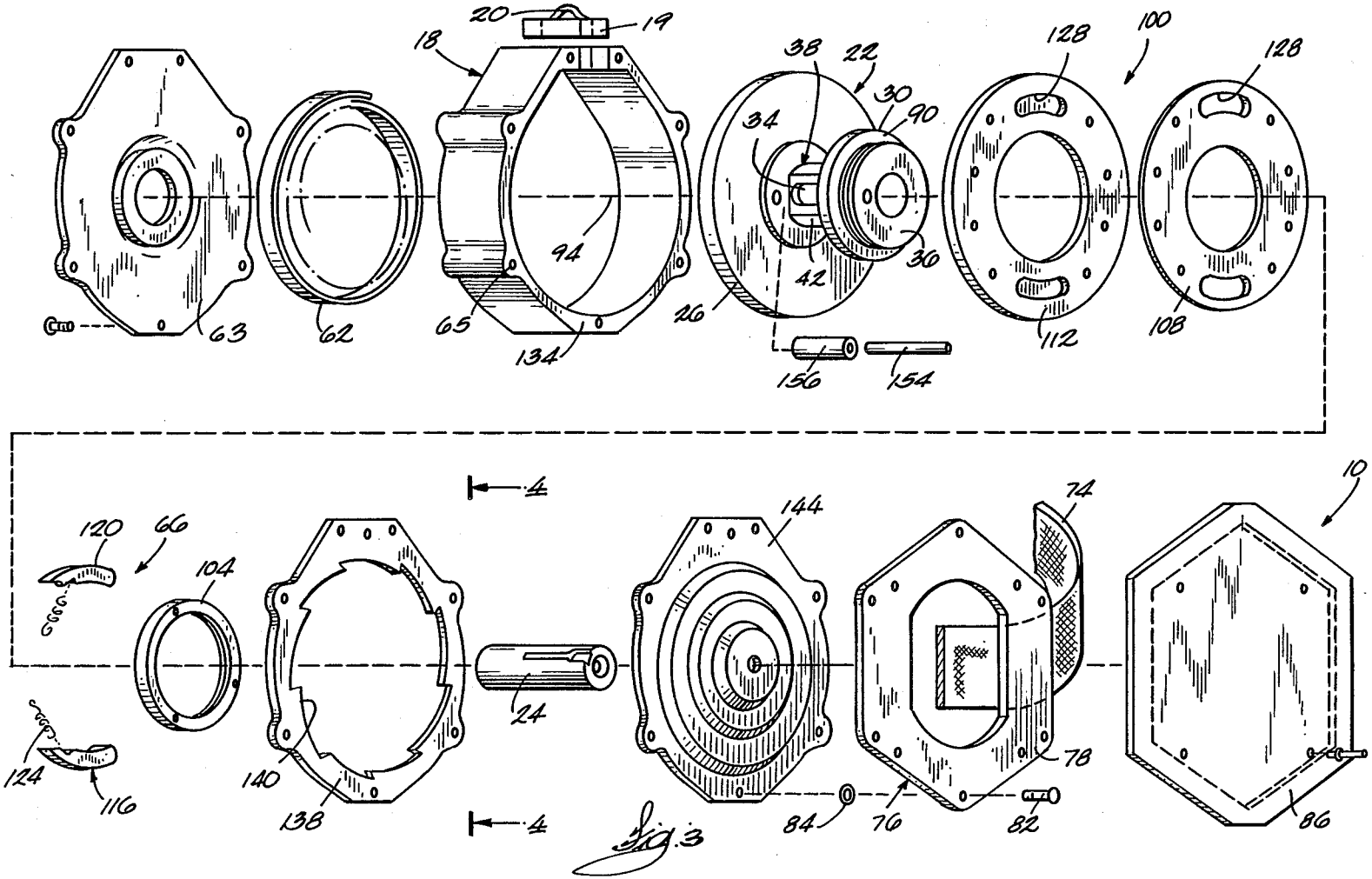
FIG. 3 is an exploded view of the safety device.

More particularly, as illustrated in FIG. 3, the safety device 10 comprises a housing 18, and a metal drum 22 rotatably mounted and contained within the housing 10. The drum 22 is rotatably mounted within the housing on a main shaft 24. The drum 22 includes a first drum flange 26, a spaced generally parallel second drum flange 30, and a cylinder 34 centrally connected between the first drum flange 26 and the second drum flange 30. The second drum flange 30 further includes a threaded extension 36 parallel to the axis of drum rotation.

Figure 1:
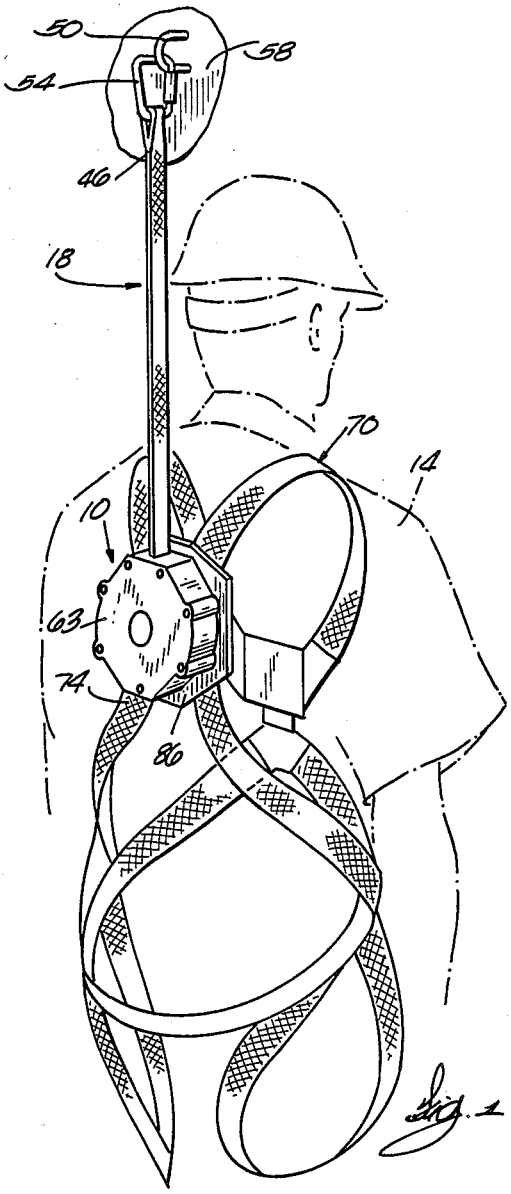
FIG. 1 is a perspective view of a body harness for a person who works at great heights. Attached to the body harness is a safety device which embodies various features of the invention

The device 10 also includes a lifeline 38. In the illustrated embodiment, the lifeline 38 is webbing, but in other embodiments, rope or cable may be used. The lifeline 38 has a first end attached to the drum cylinder 34, and a second end 46 (as shown in FIG. 1) extending outside the housing 18 and adapted to be connected to a restraint 50 in the form of a lug connected to a wall 58. In this embodiment the lifeline second end 46 includes a hook 54 for facilitating connection of the lifeline second end 46 to the lug 50. An adapter 19 having a lug 20 may optionally be attached to the housing 18 to permit connection of the device 10 to the restraint 50, and connection of the hook 54 to the person, if so desired.

Figure 5:
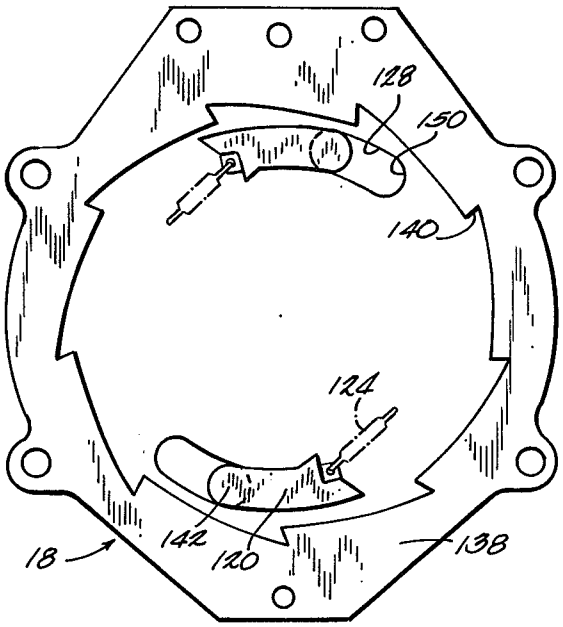
FIG. 5 is another view of the safety device shown in FIG. 4, only after the drum has been rotated in a lifeline retracting diversion by more than two degrees.
Figure 4:
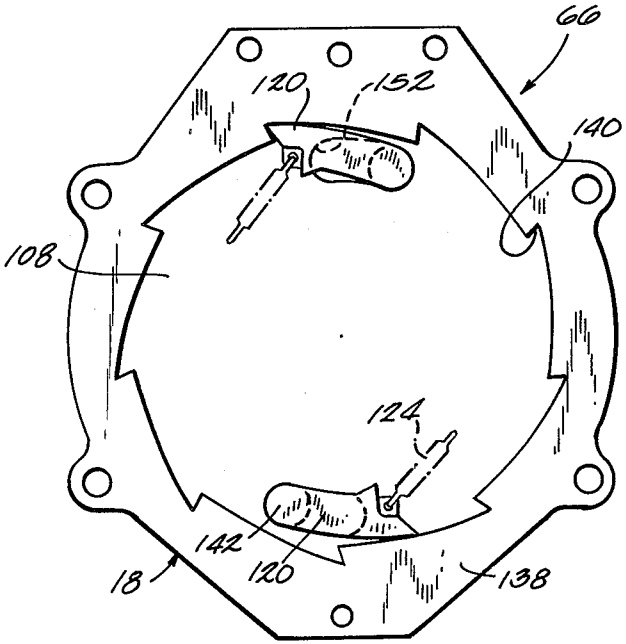
FIG. 4 is a cross-sectional view of the assembled safety device taken along the line 4—4 in FIG. 3.

The lifeline 38 is wound around the drum cylinder 34 in response to the drum 22 being rotated in a retracting direction (shown as clockwise in FIGS. 4 and 5) and the lifeline 38 is unwound from around the drum cylinder 34 in response to the drum 22 being rotated in an opposite extending direction (shown as counter-clockwise in FIGS. 4 and 5).

The device 10 also includes means for biasing the drum 22 to rotate in the retracting direction in the form of a motor spring 62 located between the first drum flange 26 and a first housing end plate 63. The motor spring 62 is connected to the first drum flange 26 and the first housing end plate 63 by appropriate stops (not shown).

Figure 2:
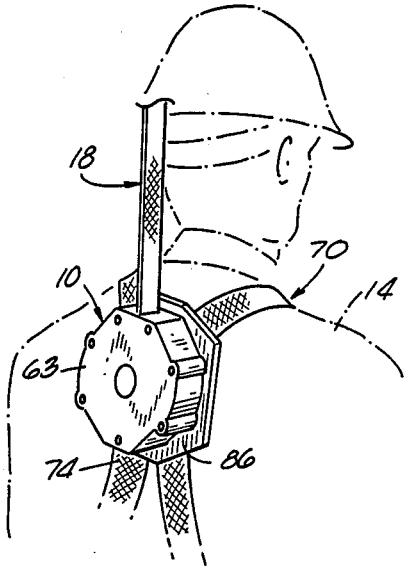
FIG. 2 is a perspective view of the safety device attached to the body harness after a person has fallen from a great height. The safety device has moved relative to the body harness, thereby assisting in holding the person in an upright position

As illustrated in FIGS. 1 and 2, the person 14 wears a body harness 70 having crossed safety straps 74 on one of the person's chest or back. The device 10 further includes attaching means 76 for slidably connecting the crossed straps to the safety device housing 18. The attaching means 76 comprises a plate 78 connected to and spaced from the housing 18 by screws 82 and washers 86 so that the crossed straps 74 can be placed between the plate 78 and the housing 18, and the straps 74 can slip between the plate 78 and the housing 18 if the person should fall. The straps 74 are also slipped through a slotted pad 86 positioned between the person 14 and the device 10.

By having the safety device 10 slip toward the head of the falling person 14 (as illustrated in FIG. 2), the device 10 helps maintain the person 14 in an upright position. This position is important as it facilitates rescue or self rescue, and is a favorable position for prolonged suspension should rescue be delayed. Enlarged bosses 65 are also incorporated into the housing 18 to facilitate connection of the plate 78 to the housing 18.

The device 10 also includes means 66 for braking extending rotation of the drum 22 at an angular velocity in excess of some predetermined speed. In the event a person falls from the surface where the person is working, the fall will cause the lifeline 38 to be extended from the housing 18 at a high angular velocity. By braking the drum 22 when the angular velocity is in excess of some predetermined speed, the safety device 10 stops any further falling of the person. An abrupt stop of the person falling increases the likelihood of injury to the person. The braking means 66 thus includes a slip clutch type of brake in order to gradually stop the person's descent.

More particularly, the drum second flange 30 has a braking surface 90 generally perpendicular to the axis of drum rotation 94, and the braking means 66 includes a disk assembly 100 in braking pressure contact with the drum brake surface 90.

The braking means further includes means 116 for fixing the drum 22 to the housing 18 in response to a predetermined speed, and for releasing the drum 22 from the housing 18 only in response to drum retracting rotation of more than ten degrees. Ten degrees rotation is the minimum amount of drum retracting rotation desirable to prevent "ratcheting" of the device 10. In the preferred embodiment, twenty degrees rotation is required.

More particularly, as illustrated in FIG. 3, the brake means 66 includes a nut 104 connected to the threaded extension 36 of the drum second flange 30. The disk assembly 100 also includes a bronze disk 108 located between the nut 104 and the drum brake surface 90. The disk assembly 100 further includes means for centering within the housing 18 the disk 108 on the drum braking surface 90. In this embodiment, the centering means is in the form of a plastic disk or flange 112. The nut 104 is torqued down sufficiently to provide an adequate amount of braking pressure (roughly 800–1000 lbs. force) between the disk 108 and the metal drum brake surface 90 and the nut 104.

The fixing means 116 comprises pawls 120 mounted on the disk assembly 100 and pivotable into engagement with the housing 18 in response to the predetermined speed. The fixing means 116 further includes means in the form of springs 124 connected between the pawls 120 and the disk 108 for biasing the pawls 120 out of engagement with the housing 18 when the drum extending rotational velocity is less than the predetermined speed. More particularly, the housing 18 includes a main housing 134, and a ratchet plate 138 connected to the main housing 134 and having ratchet teeth 140 engageable with one of the pawls 120.

The fixing means 116 further includes means for preventing the pawls 120 disengaging the housing 18 until after more than two degrees rotation of the drum 22. More particularly, the rotation preventing means 128 is in the form of a slot in the disk 108 and plastic flange 112. The slot 128 extends generally perpendicular to the disk assembly radius. The pawl 120 has a mounting pin 142, and the mounting pin 142 is slideably received in the slot 128 and is held in the slot 128 by a second housing plate 144. When the drum 22 rotates at greater than the predetermined velocity, the springs 124 extend permitting the pawls 120 to engage the teeth 140 of the ratchet plate 138. This fixes the disk assembly 100 to the housing 18, causing the drum brake surface 90 to first slide relative to the disk 108 and the nut 104 and then stop.

When the drum 22 first begins to retract the lifeline 38 after having fixed the disk assembly 100 to the housing 18, the mounting pin 142 is initially located in the first end 150 of the slot 128, as illustrated in FIG. 4. As the drum 22 begins to move in the retracting direction, one of the pawls 120 remains engaged with the teeth 140, and is not dislodged from the teeth 140 until the mounting pin 142 is engaged by the slot second end 152. After being so engaged, the pawl 120 is removed from the ratchet teeth 140, as illustrated in FIG. 5. The slot 128 thus prevents the pawls 120 from disengaging the housing 18 for at least two degrees drum rotation.

The safety device 10 further includes a shear pin 154 which is parallel to and spaced from the drum cylinder 34, with some predetermined minimum amount of lifeline 38 wound under the shear pin 154, so that the shear pin 154 must be sheared by excessive force before the predetermined amount of lifeline 38 is extended from the housing 18. The shear pin 154 is plastic, and is housed in a cylinder 156 which extends between but not into the first and second drum flanges 26 and 30, respectively.

Figure 6:
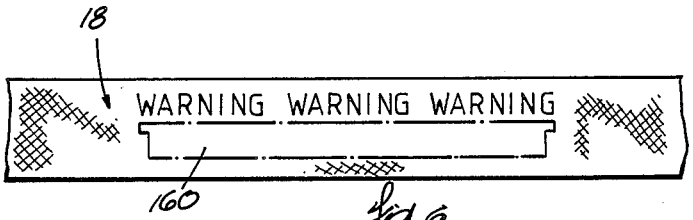
FIG. 6 is a side view of a warning label which appears on the last two feet of the lifeline Before explaining one embodiment of the invention in detail, it is to be understood that the invention is not limited in its application to the details of construction and the arrangement of components sets forth in the following description or illustrated in the drawings. The invention is capable of other embodiments, and of being practiced and carried out in various ways. Also, it is to be understood that the terminology employed herein is for the purposes of description, and should not be regarded as limiting.

More particularly, about two feet of lifeline 38 is held within the shear pin 154. In this manner, the shear pin 154 will only be broken after a person falls and the person's weight causes the shear pin 154 to shear. After this has occurred, the label 160, which appears on the last two feet of the lifeline 38 (as shown in FIG. 6), indicates that the safety device 10 must be serviced and checked prior to the safety device 10 being used again.

Various other features of the invention are set forth in the following claims.

I claim:

1. A safety device for restraining a person who works at great heights, said device comprising a housing adapted to be connected to one of the person and a restraint, a drum rotatably mounted and contained within said housing and including a first drum flange, a spaced generally parallel second drum flange having a braking surface generally perpendicular to the axis of drum rotation, and a cylinder centrally connected between said first drum flange and said second drum flange, a lifeline having a first end attached to said drum cylinder, and a second end extending outside said housing and adapted to be connected to the other of the person and the restraint, said lifeline being wound around said drum cylinder in response to said drum being rotated in a retracting direction, and said lifeline being unwound from around said drum cylinder in response to said drum being rotated in an opposite extending direction, means for biasing said drum to rotate in said retracting direction, and means for braking extending rotation of said drum at an angular velocity in excess of some predetermined speed, said braking means comprising a disk assembly in braking pressure contact with said drum brake surface, and means for fixing said disk assembly to said housing in response to the predetermined speed.

2. A safety device in accordance with claim 1, wherein said second drum flange further includes a threaded extension parallel to said axis of drum rotation, and a nut connected to said threaded extension of said drum second flange, and wherein said disk assembly further comprises a metal disk located between said nut and said drum brake surface.

3. A safety device in accordance with claim 2 wherein said disk assembly further includes means for centering within said housing said disk on said drum braking surface.

4. A safety device in accordance with claim 1, said fixing means comprising a pawl mounted on said disk assembly and pivotable into engagement with said housing in response to the predetermined speed, and means biasing said pawl out of engagement with said housing when the drum extending rotational velocity is less than the predetermined speed.

5. A safety device in accordance with claim 4 wherein said housing includes a main housing, and a ratchet plate connected to said main housing and having ratchet teeth engagable with said pawl.

6. A safety device in accordance with claim 4 and further including means for preventing said pawl disengaging said housing until after more than ten degrees retracting rotation of said drum.

7. A safety device in accordance with claim 6 wherein said disk assembly has a radius, and wherein said disengaging preventing means comprises a slot in said disk assembly and extending generally perpendicularly to said disk assembly radius, and wherein said pawl has a mounting pin, and said mounting pin is slidably received in said slot, and held in said slot by said housing so that, if said pawl is engaging said housing, said pawl continues to engage said housing until said drum and said disk assembly rotate in the retracting direction past said mounting pin, and said disk assembly engages said mounting pin thereby disengaging said mounting pin from said housing.

8. A safety device in accordance with claim 1 and further including a shear pin parallel to and spaced from said drum cylinder with some predetermined minimum amount of lifeline wound under said shear pin so that said shear pin must be sheared by substantial force before the predetermined amount of lifeline is extended from said housing.

9. A safety device in accordance with claim 1 wherein said person wears a body harness having crossed safety straps on one of the person's chest or back, and wherein said device further includes attaching means for slidably connecting said crossed straps to said housing, said attaching means comprising a plate connected to and spaced from said housing so that the crossed straps can be placed between said plate and said housing and the straps can slip between said plate and said housing if the person should fall.

10. A safety device for restraining a person who works at great heights, and who wears a body harness having crossed safety straps on one of the person's chest or back, said device comprising a housing, a drum rotatably mounted and contained within said housing, a lifeline having a first end attached to said drum, and a second end extending outside said housing and adapted to be connected to a restraint, said lifeline being wound around said drum in response to said drum being rotated in a retracting direction, and said lifeline being unwound from around said drum in response to said drum being rotated in an opposite extending direction, means biasing said drum to rotate in said retracting direction, means for braking extending rotation of said drum at an angular velocity in excess of some predetermined speed, and attaching means for slidably connecting said crossed straps to said housing, said attaching means comprising a plate connected to and spaced from said housing so that the crossed straps can be placed between said plate and said housing and the straps can slip between said plate and said housing if the person should fall.

11. A safety device for restraining a person who works at great heights, said device comprising a housing adapted to be connected to one of the person and a restraint, a drum rotatably mounted and contained within said housing, a lifeline having a first end attached to said drum, and a second end extending outside said housing and adapted to be connected to the other of the person and the restraint, said lifeline being wound around said drum in response to said drum being rotated in a retracting direction, and said lifeline being unwound from around said drum in response to said drum being rotated in an opposite extending direction, means for biasing said drum to rotate in said retracting direction, and means for braking extending rotation of said drum at an angular velocity in excess of some predetermined speed, said braking means comprising means for fixing said drum to said housing in response to the predetermined speed, and for releasing said drum from said housing only in response to drum retracting rotation of more than ten degrees.

12. A safety device for restraining a person who works at great heights, said device comprising a housing adapted to be connected to one of the person and a restraint, a drum rotatably mounted and contained within said housing and including a first drum flange, a spaced generally parallel second drum flange, and a cylinder centrally connected between said first drum flange and said second drum flange, a lifeline having a first end attached to said drum cylinder, and a second end extending outside said housing and adapted to be connected to the other of the person and the restraint, said lifeline being wound around said drum cylinder in response to said drum being rotated in a retracting direction, and said lifeline being unwound from around said drum cylinder in response to said drum being rotated in an opposite extending direction, means for biasing said drum to rotate in said retracting direction, means for braking extending rotation of said drum at an angular velocity in excess of some predetermined speed, and a shear pin parallel to and spaced from said drum cylinder with some predetermined minimum amount of lifeline wound under said shear pin so that said shear pin must be sheared by excessive force before the predetermined amount of lifeline is extended from said housing.

* * * * *